US011437748B2

(12) United States Patent
Smith et al.

(10) Patent No.: US 11,437,748 B2
(45) Date of Patent: Sep. 6, 2022

(54) QUICK DISCONNECT ELECTRICAL CONNECTOR WITH CIRCULAR CONTACTS

(71) Applicant: TE Connectivity Services GmbH, Schaffhausen (CH)

(72) Inventors: Rodney T. Smith, Hummelstown, PA (US); Keith E. Miller, Manheim, PA (US); Kyle M. Doll, Dillsburg, PA (US); Tim R. Chevalier, Cleona, PA (US)

(73) Assignee: TE CONNECTIVITY SOLUTIONS GmbH, Schaffhausen (CH)

( * ) Notice: Subject to any disclaimer, the term of this patent is extended or adjusted under 35 U.S.C. 154(b) by 0 days.

(21) Appl. No.: 17/066,661

(22) Filed: Oct. 9, 2020

(65) Prior Publication Data

US 2022/0115803 A1 Apr. 14, 2022

(51) Int. Cl.

| | |
|---|---|
| ***H01R 13/24*** | (2006.01) |
| ***H01R 24/38*** | (2011.01) |
| ***H01R 13/52*** | (2006.01) |
| ***H01R 13/627*** | (2006.01) |
| ***H01R 39/64*** | (2006.01) |

(52) U.S. Cl.

CPC ..... *H01R 13/2478* (2013.01); *H01R 13/5219* (2013.01); *H01R 13/6277* (2013.01); *H01R 24/38* (2013.01); *H01R 39/64* (2013.01)

(58) Field of Classification Search

None

See application file for complete search history.

(56) References Cited

U.S. PATENT DOCUMENTS

| | | | | |
|---|---|---|---|---|
| 7,056,127 | B2 * | 6/2006 | Suzuki | H01R 13/6205 439/22 |
| 9,281,638 | B2 | 3/2016 | McBroom et al. | |
| 10,547,141 | B2 | 1/2020 | Alrashed | |
| 10,574,006 | B2 * | 2/2020 | Storione | H01R 13/6276 |
| 10,777,931 | B2 * | 9/2020 | Fukazawa | H01R 13/5219 |
| 2015/0336677 | A1 | 11/2015 | Smaoui et al. | |
| 2021/0237606 | A1 * | 8/2021 | McNair | H01R 24/00 |

OTHER PUBLICATIONS

Amphenol Ltd, Stingray Magnetic Connector Series, May 2018, pp. 1-8, United Kingdom.

International Search Report, International Application No. PCT/IB2021/059219, International Filing Date, Oct. 7, 2020.

* cited by examiner

*Primary Examiner* — Ross N Gushi

(57) ABSTRACT

An electrical connector assembly for mating with a mating connector assembly. The connector assembly includes a housing with a cable receiving portion and a mating portion. The housing has a first surface and an oppositely facing second surface. A mating projection extends from the first surface in a direction away from the second surface. The mating projection has a circular cross-sectional configuration. The mating projection has an angled wall which extends from the first surface to a mating face, the angled wall is angled relative to a plane of the first surface and a plane of the mating face. The mating face has contacts extending therethrough. The contacts have circular engagement sections arranged concentrically about a center of the mating face. A securing recess is provided in the angled wall, the securing recess extends about the outside circumference of the angled wall.

18 Claims, 6 Drawing Sheets

QUICK DISCONNECT ELECTRICAL CONNECTOR WITH CIRCULAR CONTACTS

FIELD OF THE INVENTION

The present invention is directed to a quick disconnect electrical connector with circular contacts. In particular, the invention is directed to an electrical connector which can be easily mated with a mating connector and which can easily breakaway from a mating connector from any direction.

BACKGROUND OF THE INVENTION

Connectors or connector assemblies are often mechanically secured to mating connectors, connector assemblies or panels to prevent the unwanted removal of the connector assembly from the mating connector assembly or panels. Mechanically secured connector assemblies typically employ push-pull, lever-actuated, partial-turn, or other manual locking mechanisms that are designed to release only with specific user intervention initiated directly at the connector interface and are otherwise engineered to hold tight—sometimes withstanding a pull force of dozens or even hundreds of pounds.

However, in many applications there is a need for connectors that are engineered to hold tight up to a predetermined point and then, when that force is reached, smoothly and cleanly let go. Breakaway connectors, which are also known as quick-release or quick-disconnect connectors, are often employed in applications including aviation and military helmets and headsets that attached to consoles or portable equipment with cables, mobile medical monitoring equipment attached to patients, and in other environments in order to prevent cord entanglement, snags, and pulls from hindering or harming the user and equipment they're attached to.

While various breakaway, quick-release or quick-disconnect connectors are currently available, such connectors are generally designed to release when an appropriate force is applied to the cable or connector in a direction which is in line with the longitudinal axis of the connector. However, such connectors fail to properly release if a force is applied to the cable or connector in a direction other than in line with the longitudinal axis of the connector, such as a force applied with a component which is perpendicular to in line with the longitudinal axis of the connector. The inability to release when such a force is applied can cause damage to the equipment and harm to the user.

In addition, many breakaway connectors do not allow mating from any direction. This can cause difficulties, as in many environments, it is difficult to properly align the mating connectors, as connection needs to be done quickly or without a clear line of sight.

It would be, therefore, beneficial to provide an electrical connector or connector assembly which can be easily mated in from any direction and which can easily breakaway from a mating connector, connector assembly or panel upon the application of designated force, regardless of the direction the force is applied to the connector or connector assembly.

SUMMARY OF THE INVENTION

An embodiment is directed to an electrical connector assembly for mating with a mating connector assembly. The connector assembly includes a housing with a cable receiving portion and a mating portion. The housing has a first surface and an oppositely facing second surface. A mating projection extends from the first surface in a direction away from the second surface. The mating projection has a circular cross-sectional configuration. The mating projection has an angled wall which extends from the first surface to a mating face, the angled wall is angled relative to a plane of the first surface and a plane of the mating face. The mating face has contacts extending therethrough. The contacts have circular engagement sections arranged concentrically about a center of the mating face. A securing recess is provided in the angled wall, the securing recess extends about the outside circumference of the angled wall.

An embodiment is directed to an electrical connector assembly for mating with a mating connector assembly. The connector assembly includes a housing having a first surface and a second surface. A mating recess extends from the first surface in a direction toward the second surface. The mating recess has a sloped surface, the sloped surface is sloped relative to a plane of the first surface of the housing. Contacts extend through a bottom surface of the mating recess. The contacts having resilient mating sections which extend from the bottom surface in a direction toward the first surface of the housing. A seal is provided about a circumference of the mating recess. A resilient member is provided in the mating recess. The resilient member is configured to be resiliently deformable away from a longitudinal axis of the mating recess.

An embodiment is directed to a breakaway electrical connector assembly with a first connector assembly and a second connector assembly. The first connector assembly includes a housing with a cable receiving portion and a mating portion. The housing has a first surface and an oppositely facing second surface. A mating projection extends from the first surface in a direction away from the second surface. The mating projection has a circular cross-sectional configuration. The mating projection has an angled wall which extends from the first surface to a mating face, the angled wall is angled relative to a plane of the first surface and a plane of the mating face. The mating face has contacts extending therethrough. The contacts have circular engagement sections arranged concentrically about a center of the mating face. A securing recess is provided in the angled wall, the securing recess extends about the outside circumference of the angled wall. The second connector assembly includes a housing having a first surface and a second surface. A mating recess extends from the first surface in a direction toward the second surface. The mating recess has a sloped surface, the sloped surface is sloped relative to a plane of the first surface of the housing. Contacts extend through a bottom surface of the mating recess. The contacts having resilient mating sections which extend from the bottom surface in a direction toward the first surface of the housing. A seal is provided about a circumference of the mating recess. A resilient member is provided in the mating recess. The resilient member is configured to be resiliently deformable away from a longitudinal axis of the mating recess.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
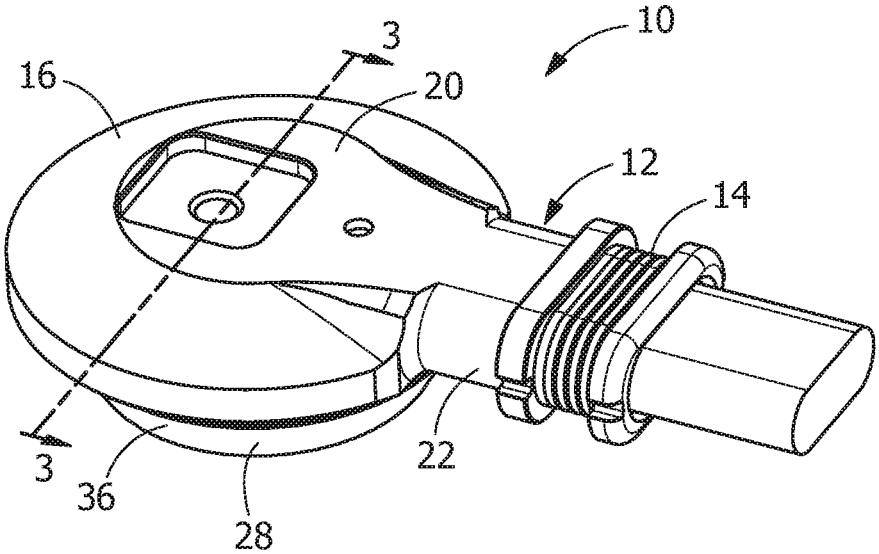
FIG. 1 is a bottom perspective view of an illustrative embodiment of an electrical connector assembly of the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

Figure 2:
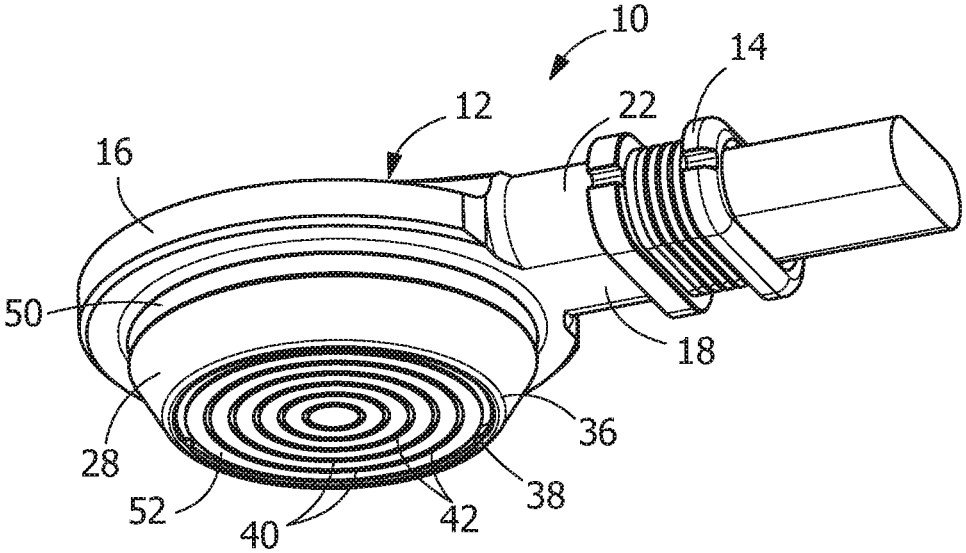
FIG. 2 is a top perspective view of the electrical connector assembly of FIG. 1.

As shown in FIGS. 1 and 2, an electrical connector assembly 10 has a housing 12 with a cable receiving portion 14 and a mating portion 16. The housing 12 has a first surface 18 and an oppositely facing second surface 20. Sidewalls 22 extend between the first surface 18 and the second surface 20.

In the illustrative embodiment shown, the mating portion 16 have a circular configuration. However, the mating portion 16 may have other configurations without departing from the scope of the invention.

Figure 4:
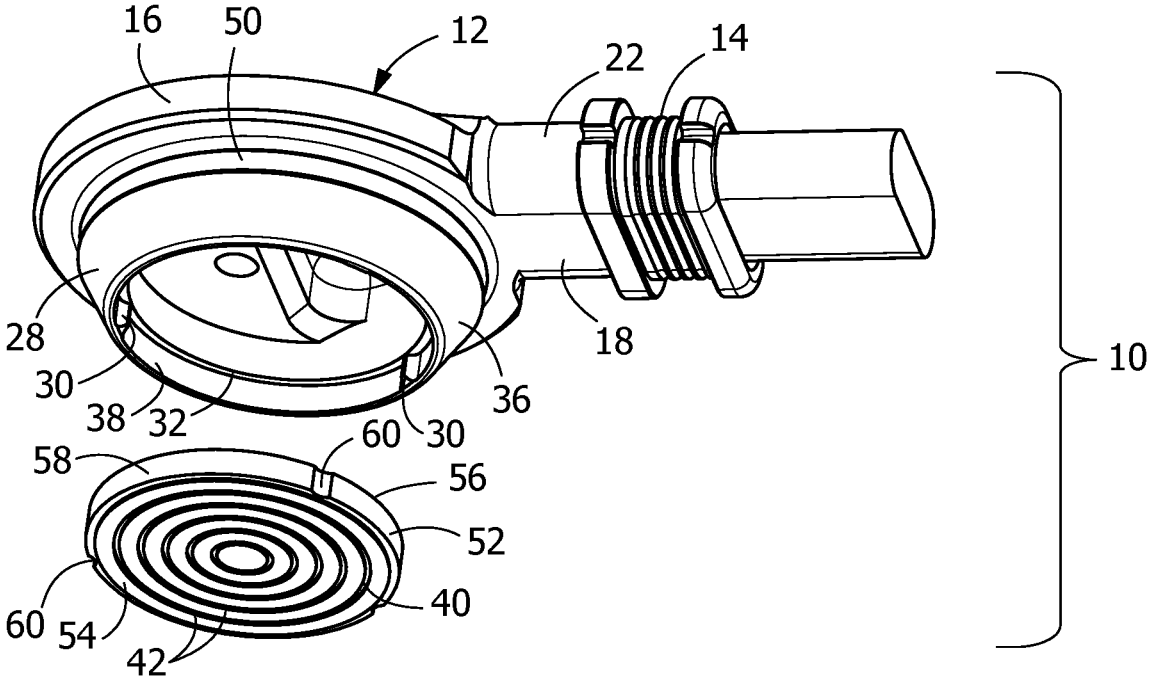
FIG. 4 is an exploded view of the electrical connector assembly of FIG. 1.

As shown in FIGS. 2 and 4, a mating projection 28 extends from the first surface 18 in a direction away from the second surface 20. The mating projection 28 has a generally circular cross-sectional configuration.

The mating projection 28 has an angled or sloped surface or wall 36 which extends from the first surface 18 to a mating face 38. Positioning or securing projections 30 (FIG. 4) are provided on an inside surface of the angled or sloped wall 36. A positioning shoulder 32 extends about the circumferences of the inside surface of the angled or sloped wall 36. The positioning shoulder 32 is spaced from the mating face 38.

The angled or sloped wall 36 is angled relative to the first surface 18 and the mating face 38. While the angle may vary depending upon the length of the mating projection 28, in the illustrative embodiment shown, the angled or sloped wall 36 is angled approximate 25 to 50 degrees relative to the mating face 38.

A securing or clip-receiving recess 50 is provided on an outside surface of the angled or sloped wall 36. The securing or clip-receiving recess 50 extends about the outside circumference of the angled or sloped wall 36. In the illustrative embodiment shown, the securing or clip-receiving recess 50 is provide proximate or adjacent to the first surface 18.

As shown in FIGS. 1 and 2, the cable receiving portion 14 extends from the mating portion 16. In the illustrative embodiment shown, cross-sections of the cable receiving portion 14 have a generally oval configuration. However, other configurations of the cable receiving portion 14 may be used.

Figure 3:
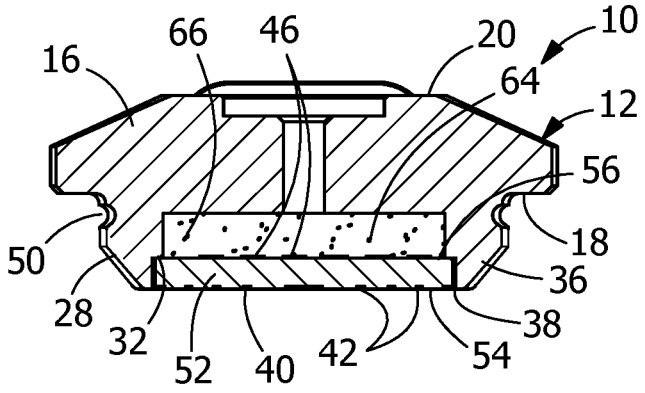
FIG. 3 is a cross-sectional view of the electrical connector assembly taken along line 3-3 of FIG. 1.

As shown in FIGS. 3 and 4, the electrical connector assembly 10 has a board or substrate 52 through which contacts 40 extend. The substrate 52 has a first surface 54 and an oppositely facing second surface 56. A side surface 58 extends between the first surface 54 and the second surface 56. Positioning recesses 60 are provided on the side surfaces 58.

Each of the contacts 40 have an engagement section 42, a transition section (not shown) and a wire termination section 46 (FIG. 3). The engagement sections 42 are circular tracks or contacts which are arranged concentrically about the center of the mating face 38.

As shown in FIG. 3, the substrate 52 is press fit into the interior of the housing 12 through the mating projection 28 and retained therein. The second surface 56 of the substrate 52 engages the positioning shoulder 32 to properly position the substrate 52 in the housing 12. In this position, the positioning or securing projections 30 are positioned in the positioning recesses 60 on the side surfaces 58 of the substrate. The interaction of the positioning projections 30 with the positioning recesses 60 maintains the substrate 52 relative to the housing 12. In this position, a cable receiving interior cavity 64 (FIG. 3) is provided to accommodate the ends of individual wires of the cable (not shown).

With the substrate 52 properly positioned, the first surface 54 of the substrate 52 forms a portion of the mating face 38. When assembled, the circular tracks or engagement sections 42 of the contacts 40 are positioned on the mating face 38, the transition sections (not shown) extend through the substrate 52, and the wire terminations section 46 are terminated to the wires of a cable. The termination of the wires to the wire terminations section 46 may be done by soldering or other known termination methods.

With the contacts 40 properly terminated and the board or substrate 52 properly positioned electrical connector assembly 10, an epoxy 66 is provide in an interior cavity 64 of the electrical connector assembly 10 to properly maintain the substrate 52 in position and to seal the interior cavity 64 to prevent moisture or debris from interfering with the connection between the termination sections 46 of the contacts 40 and the wires (not shown).

As shown in FIGS. 5 through 9, a mating electrical connector assembly 110 has a housing 112 with a cable receiving portion 114 and a mating portion 116. The housing 112 has a first surface 118 and an oppositely facing second surface 120. Sidewalls 122 extend between the first surface 118 and the second surface 120.

Figure 5:
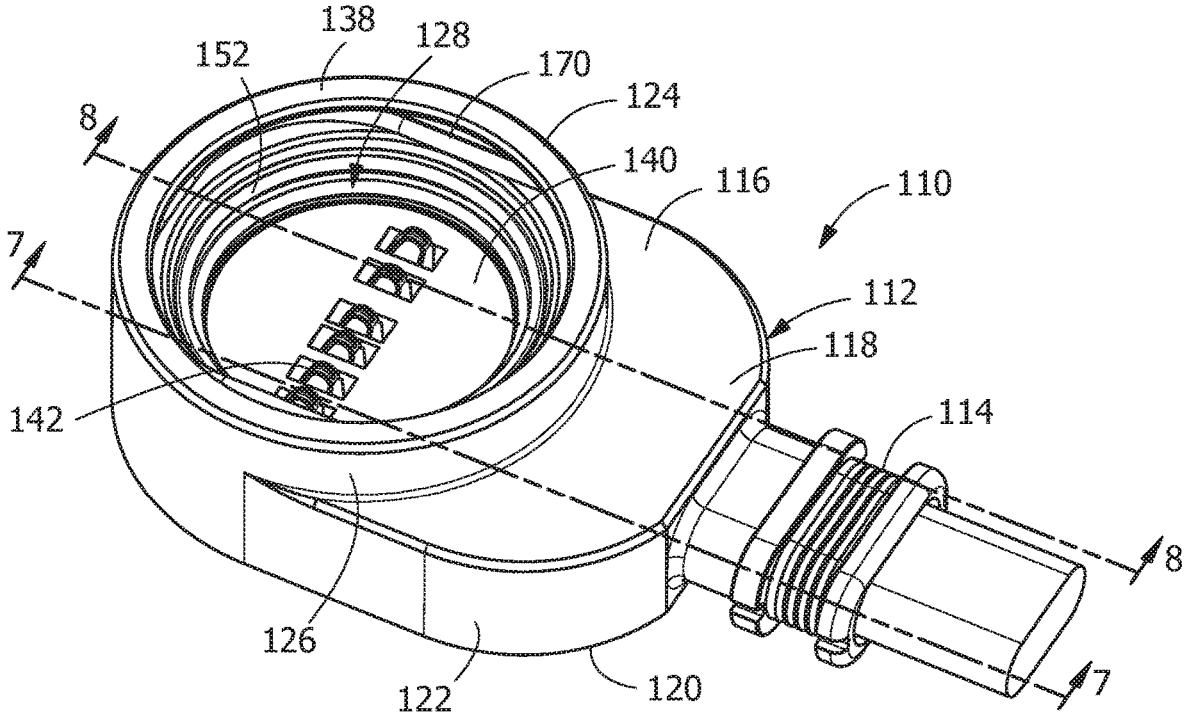
FIG. 5 is a top perspective view of an illustrative embodiment of a mating electrical connector assembly of the present invention.

As shown in FIG. 5, the mating portion 116 has a mating projection 124 that extends from the first surface 118 in a direction away from the second surface 120 to a mating surface 138. The mating projection 124 has a circular cross-sectional configuration and has a side wall 126. The side wall 126 forms a mating recess 128 which extends from the mating surface 138 toward the second surface 120. The mating recess 128 has a generally circular configuration.

An angled or sloped surface or portion 132 of the sidewall 126 extends from the mating surface 138 to a mating face 140. The angled or sloped portion 132 is angled relative to the mating surface 138 and the mating face 140. While the angle may vary depending upon the depth of the mating recess 128, in the illustrative embodiment shown, the angled or sloped portion 132 is angled approximate 25 to 50 degrees relative to the mating face 140. The angle of the angled or sloped portion 132 is configured to be approximately equal to the angle of the angled or sloped wall 36 of the mating projection 28 of the connector assembly 10.

The mating face 140 has contacts 142 provided thereon or extending therethrough. In this illustrative embodiment shown in FIGS. 7 and 8, the contacts 142 have mating sections 144, a transition sections 146 and wire termination sections 148.

Figure 7:
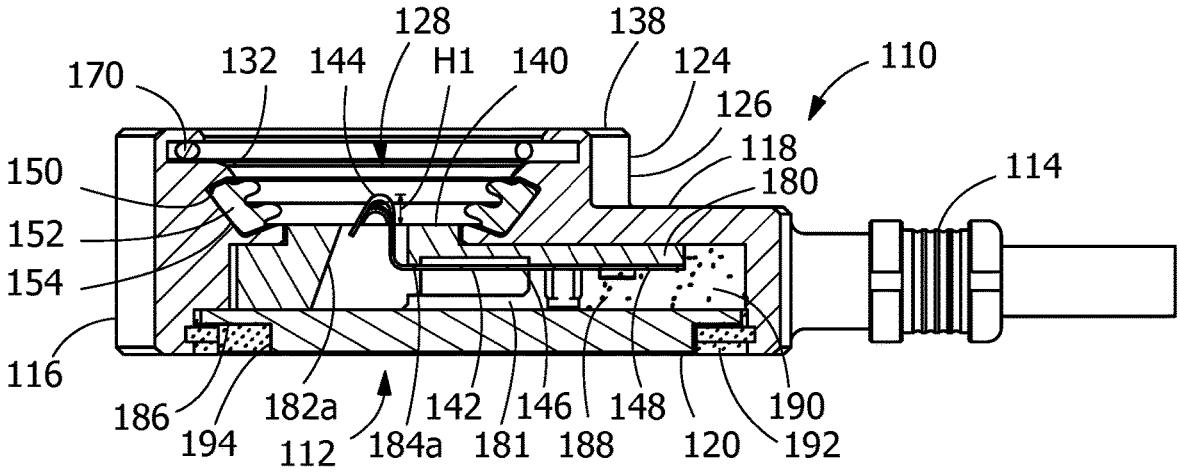
FIG. 7 is a cross-sectional view of the mating electrical connector assembly taken along line 7-7 of FIG. 5.
Figure 8:
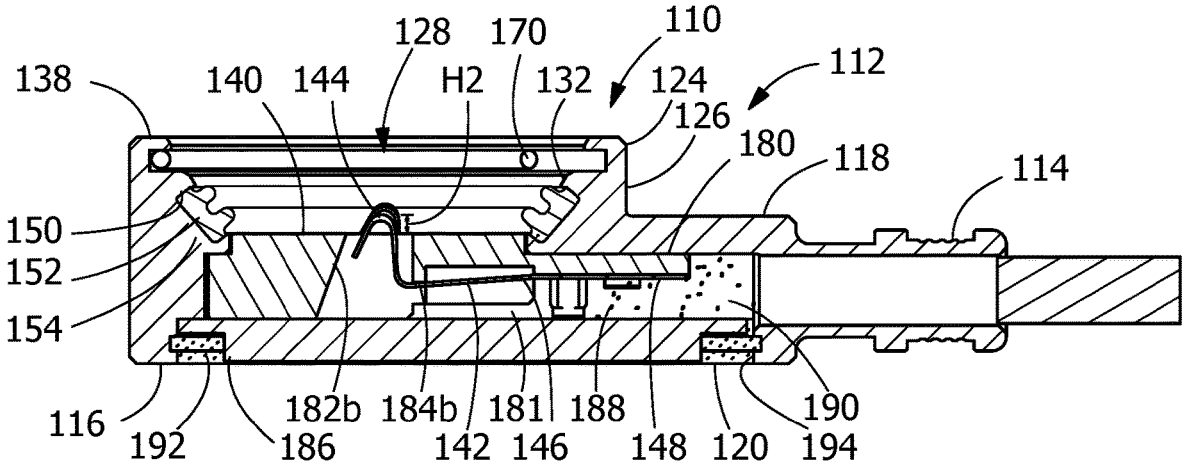
FIG. 8 is a cross-sectional view of the mating electrical connector assembly taken along line 8-8 of FIG. 5.

As shown in FIGS. 5, 7 and 8, the angled or sloped portion 132 has a circumferential seal receiving recess 150. A seal 152 is positioned in the seal receiving recess 150. A back wall 154 of the seal receiving recess 150 is angled at approximately the same angle as the angled or sloped surface 132 is angled relative to the mating face 140.

Figure 9:
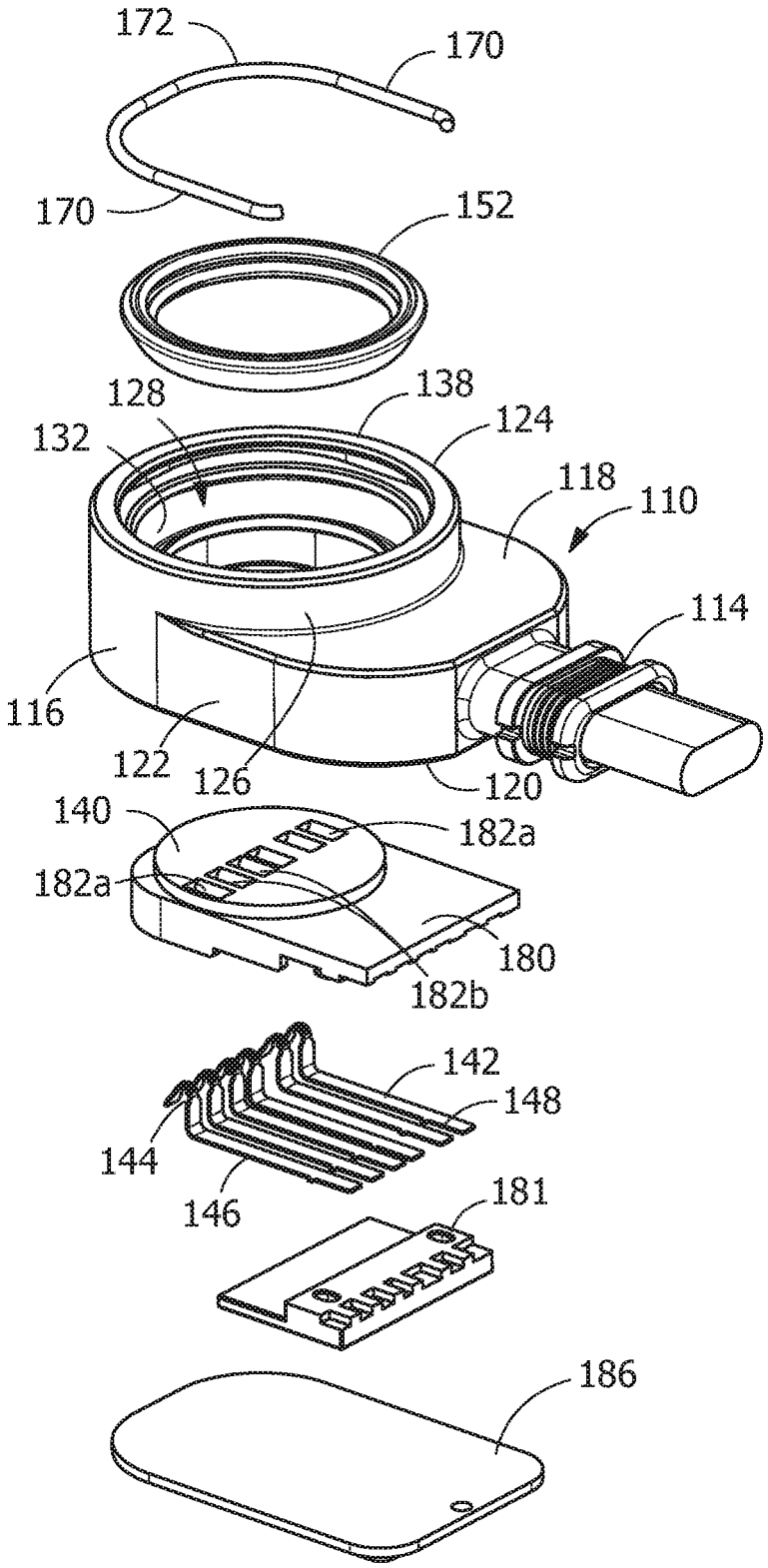
FIG. 9 is an exploded view of the mating electrical connector assembly of FIG. 5.

Legs 170 of a resilient securing member 172 are provided in the mating recess 128. The legs 170 are a portion of a U-shaped resilient securing member 172 (FIG. 9). The legs 170 are resiliently deformable away from a longitudinal axis of the mating recess 128 as the mating projection 28 of connector assembly 10 is positioned in the mating recess 128 of mating connector assembly 110, as will be more fully described.

Figure 6:
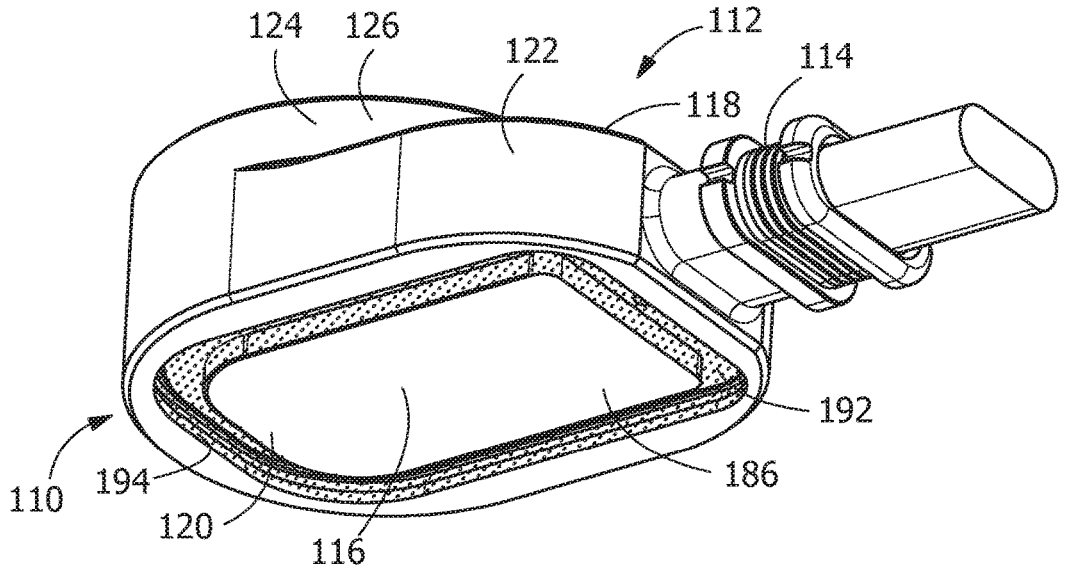
FIG. 6 is a bottom perspective view of the mating electrical connector assembly of FIG. 5.

As shown in FIGS. 5 and 6, the cable receiving portion 114 extends from the mating portion 116. In the illustrative embodiment shown, cross-sections of the cable receiving portion 114 have a generally oval configuration. However, other configurations of the cable receiving portion 114 may be used.

In the illustrative embodiment shown, the connector assembly 110 has a first contact receiving member 180 and a second contact receiving member 181 which are used to properly position and retain the contacts 142 in position. A surface of the first contact receiving member 180 is the mating face 140.

The first contact receiving member 180 has openings 182*a*, 182*b* which extend therethrough and which are configured to receive the mating sections 144 of the contacts 142 therein. Openings 182*a* have a smaller projection 184*a* which cooperates with the transition portions 146 of the contacts 142 to allow the transition portions 146 to be positioned essentially parallel to the mating face 140. This allows the resilient mating sections 144 of the contacts 142 in openings 182*b* to extend a height H1 above the mating face 140. Openings 182*b* have a larger projection 184*b* which cooperates with the transition portions 146 of the contacts 142 to allow the transition portions 146 to be positioned at an angle relative to the mating face 140. This allows the mating sections 144 of the contacts 142 in openings 182*a* to extend a height H2 above the mating face 140.

While the mating portions 144 of the contacts 142 are retained in an initial position, the mating portions 144 and the transition portions 146 are able to move in a direction which is parallel to the direction of mating of the connector assembly 10 with the connector assembly 110 to allow the contacts 142 to be resiliently moved as insertion occurs.

A cover 186 is provided on the second surface 120 of the connector assembly 110. When assembled the cover 186 defines a cable receiving interior cavity 188 which accommodates the ends of individual wires of the cable (not shown).

With the contacts 142 properly terminated and the components properly positioned electrical connector assembly 110, an epoxy 190 is provided in an interior cavity 188 of the electrical connector assembly 110 and epoxy 192 is provided in exterior cavity 194 to properly maintain the components in position and to seal the interior cavity 188 to prevent moisture or debris from interfering with the connection between the termination sections 148 of the contacts 142 and the wires (not shown).

While illustrative contacts 142 are shown and described above, other types of contacts may be used. For example, the contacts 142 may be spring probes. Spring probes would require only one contact receiving member, as the spring probes could be press fit into the contact receiving member with wires soldered on wire termination sections which are provided on ends of the contacts which are opposite the mating portions of the contacts.

Figure 10:
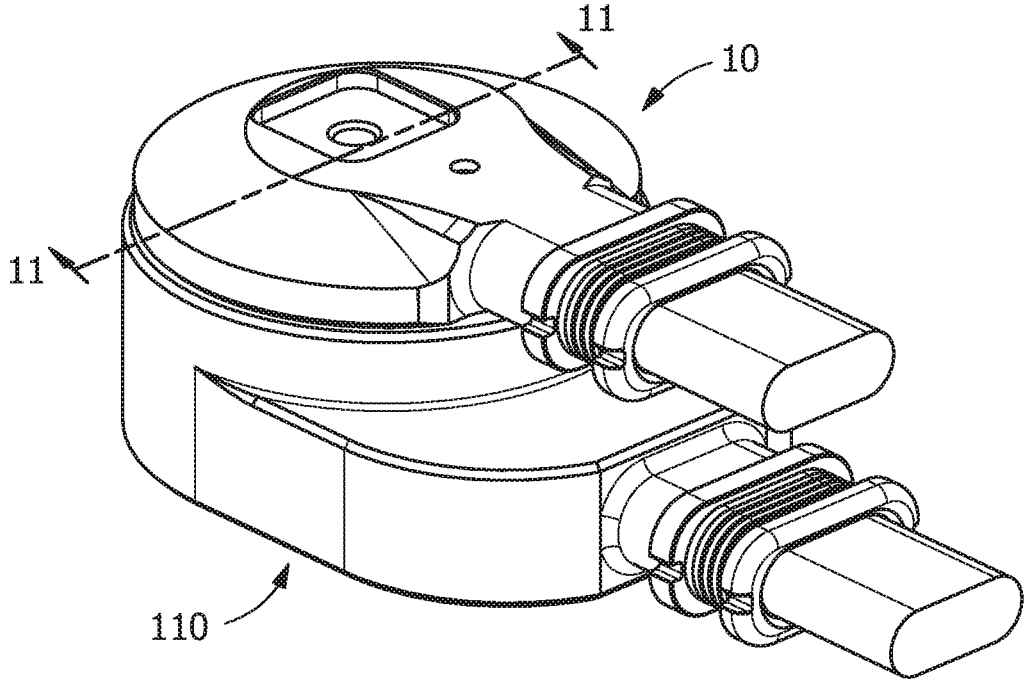
FIG. 10 is a top perspective view of the electrical connector assembly of FIG. 1 mated with the mating connector assembly of FIG. 5.
Figure 11:
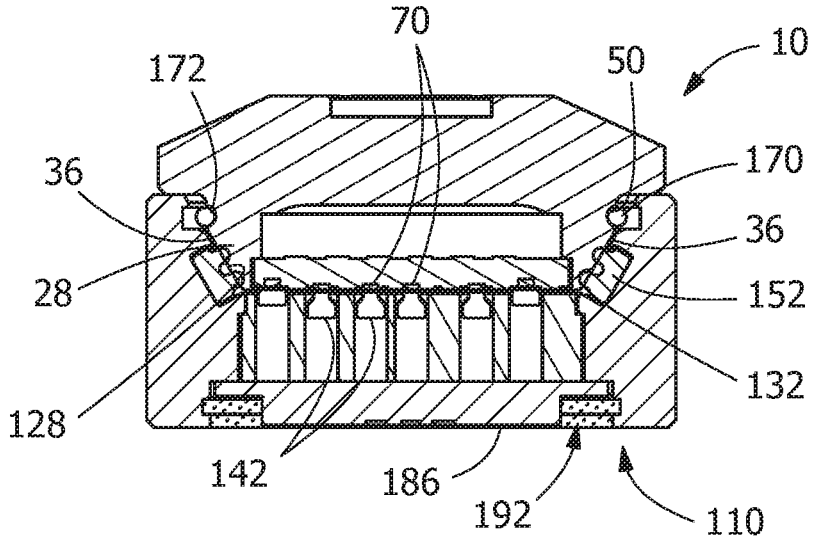
FIG. 11 is a cross-sectional view of the mating electrical connector assembly and mated with the mating connector assembly taken along line 11-11 of FIG. 10.

In use, the connector assembly 10 and mating connector assembly 110 are mated together to form a mechanical and electrical connection therebetween, as shown in FIGS. 10 and 11. As the engagement sections 42 of the contacts 40 are circular tracks or contacts which are arranged concentrically about the center of the mating face 38, and as the mating projection 28 and the mating recess 128 are circular, the connector assembly 10 may be mounted to the mating connector assembly 110 from any orientation (360 degrees) to make the mechanical and electrical engagement. In addition, the connector assembly 10 may be rotated relative to the mating connector assembly 110.

As the connector assembly 10 is moved into engagement with the connector assembly 110, the angled or sloped wall 36 of the connector assembly 10 engages the seal 152 positioned on the angled or sloped portion 132 of the mating connector assembly 110. The legs 170 of the resilient securing member 172 are moved outward as the mating projection 28 is inserted into the mating recess 128.

As the mating occurs, the mating sections 144 of the contacts 142 positioned in openings 182*a* engage the engagement sections 42 of the contacts 40 prior to the mating sections 144 of the contacts 142 positioned in openings 182*b* engage the engagement sections 42 of the contacts 40. This allow the mating sections 144 of the contacts 142 positioned in openings 182*a* to make electrical engagement with respective engagement sections 42 of the contacts 40 prior to the mating sections 144 of the contacts 142 positioned in openings 182*b* making electrical engagement with other respective engagement sections 42 of the contacts 40

With the mating projection 28 fully inserted into the mating recess 128, the legs 170 enter the securing recess 50 positioned in the sidewall 36 of the mating projection 28 of the connector assembly 10. As this occurs, the legs 170 move back toward their unstressed position, thereby exerting a retention force on the securing recess 50 and the mating projection 28 to retain the mating projection 28 in the mating recess 128, allowing the contacts 40 and contacts 142 to be retained in mechanical and electrical engagement.

The legs 170 of the resilient securing member 172 can be configured to allow the retention force to be configured for a particular implementation and a particular force as desired. In various embodiments, the retention force is configured to be small, in the range of between 1-5 lbs. to allow the connector assembly 10 to be easily removed from the mating connector assembly 110 when a force is applied to either the connector assembly 10 or the mating connector assembly 110. In other embodiments, the retention force is configured to be large, in the range of between 5-15 lbs., to prevent the connector assembly 10 from being easily removed from the mating connector assembly 110 when a force is applied to either the connector assembly 10 or the mating connector assembly 110.

In various environments, it is important that the connector assembly 10 be allowed to be mated from any direction and be removed or break away from the mating connector assembly 110 when a designated amount of force is applied from any direction to the connector assembly 10 or the mating connector assembly 110. To allow the connector assembly 10 and mating connector assembly 110 to be properly released in different directions, the retention force of the securing member 172 and the angles of the angled or sloped wall 36 and the angled or sloped portion 132 must be controlled.

Accordingly, the electrical connector or connector assembly, as described herein, can be mounted from any direction, without the need for pre-alignment, and can be easily broken away from the mating connector, connector assembly upon the application of designated force, regardless of the direction the force is applied to the connector or connector assembly. The ability to mate and release in different directions allows the connector assembly to be used in many applications or environments to prevent damage to the equipment and prevent harm to the user.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

We claim:

1. An electrical connector assembly for mating with a mating connector assembly, the connector assembly comprising:

a housing having a cable receiving portion and a mating portion, the housing having a first surface and an oppositely facing second surface;

a mating projection extending from the first surface in a direction away from the second surface, the mating projection having a circular cross-sectional configuration, the mating projection having an angled wall which extends from the first surface to a mating face, the angled wall being angled relative to a plane of the first surface and a plane of the mating face;

the mating face having contacts extending therethrough, the contacts having circular engagement sections arranged concentrically about a center of the mating face;

a substrate through which the contacts extend, the substrate being press fit into an interior of the housing, a surface of the substrate is the mating face; and a securing recess provided in the angled wall, the securing recess extends about the outside circumference of the angled wall.

2. The electrical connector assembly as recited in claim 1, wherein the mating portion has a circular configuration.

3. The electrical connector assembly as recited in claim 1, wherein the contacts have transition sections which extend from the engagement sections, and wire termination sections which extend from the transition sections.

4. The electrical connector assembly as recited in claim 1, wherein the angled wall is angled between 25 to 50 degrees relative to the mating face.

5. The electrical connector assembly as recited in claim 1, wherein the securing recess is proximate or adjacent to the first surface.

6. The electrical connector assembly as recited in claim 5, wherein the securing recess is a clip-receiving recess.

7. The electrical connector assembly as recited in claim 1, wherein an epoxy is provided in an interior cavity of the electrical connector assembly to properly maintain the substrate in position and to seal the interior cavity.

8. An electrical connector assembly for mating with a mating connector assembly, the connector assembly comprising:

a housing having a first surface and a second surface;

a mating recess extending from the first surface in a direction toward the second surface, the mating recess having a sloped surface, the sloped surface is sloped relative to a plane of the first surface of the housing;

contacts extending through a bottom surface of the mating recess, the contacts having a resilient mating section extending from the bottom surface in a direction toward the first surface of the housing;

a seal provided about a circumference of the mating recess; and a resilient member provided in the mating recess, the resilient member having legs which extend into the mating recess, the legs being resiliently deformable away from a longitudinal axis of the mating recess as a mating projection of the mating connector assembly is positioned in the mating recess of electrical connector assembly.

9. The electrical connector assembly as recited in claim 8, wherein the sloped surface extends from the proximate the first surface to the bottom surface of the mating recess, the sloped surface is angled relative to the first surface and the bottom surface.

10. The electrical connector assembly as recited in claim 8, wherein the sloped surface has a circumferential seal receiving recess, the seal is positioned in the seal receiving recess.

11. The electrical connector assembly as recited in claim 8, wherein the housing has a cable receiving portion and a mating portion.

12. The electrical connector assembly as recited in claim 11, wherein the mating portion has a mating projection that extends from the first surface in a direction away from the second surface to a mating surface, the mating projection has a circular cross-sectional configuration and has a side wall, the side wall forms the mating recess, the mating recess has a generally circular configuration.

13. The electrical connector assembly as recited in claim 12, wherein the mating recess extends from the mating recess to a mating face which has contacts extending therethrough.

14. The electrical connector assembly as recited in claim 13, wherein the contacts have mating sections, transition sections and wire termination sections.

15. The electrical connector assembly as recited in claim 8, wherein the connector assembly has a first contact receiving member and a second contact receiving member which are used to properly position and retain the contacts is position, a surface of the first contact receiving member is the mating face.

16. The electrical connector assembly as recited in claim 15, wherein the first contact receiving member has first openings and second openings which extend therethrough and which are configured to receive the mating sections of the contacts therein, the first openings have a smaller projection which cooperates with the transition portions of the contacts to allow the transition portions to be positioned essentially parallel to the mating face, thereby allowing the resilient mating sections of the contacts in first openings to extend a first height above the mating face, the second openings have a larger projection which cooperates with the transition portions of the contacts to allow the transition portions to be positioned at an angle relative to the mating face, thereby allowing the mating sections of the contacts in the second openings to extend a second height above the mating face.

17. The electrical connector assembly as recited in claim 16, wherein a cable receiving interior cavity is provided in the housing, an epoxy is provided in an interior cavity.

18. A breakaway electrical connector assembly comprising:

a first connector assembly comprising:

a housing having a cable receiving portion and a mating portion, the housing having a first surface and an oppositely facing second surface;

a mating projection extending from the first surface in a direction away from the second surface, the mating projection having a circular cross-sectional configuration, the mating projection having an angled wall which extends from the first surface to a mating face, the angled wall being angled relative to a plane of the first surface and a plane of the mating face;

the mating face having contacts extending therethrough;

a securing recess provided in the angled wall, the securing recess extends about the outside circumference of the angled wall; and a second connector housing comprising:

a housing having a first surface and a second surface;

a mating recess extending from the first surface in a direction toward the second surface, the mating recess having a sloped surface, the sloped surface is sloped relative to a plane of the first surface of the housing;

contacts extending through a bottom surface of the mating recess;

a seal provided about a circumference of the mating recess; and a resilient member provided in the mating recess, the resilient member having legs which extend into the mating recess, the legs being resiliently deformable away from a longitudinal axis of the mating recess as a mating projection of the mating connector assembly is positioned in the mating recess of electrical connector assembly.

* * * * *